United States Patent [19]

Roenna

[11] 3,971,506

[45] July 27, 1976

[54] TEAR OPEN AND RELOCKABLE CONTAINER

[75] Inventor: Robert Fred Roenna, Medinah, Ill.

[73] Assignee: St. Regis Paper Company, New York, N.Y.

[22] Filed: Nov. 27, 1974

[21] Appl. No.: 527,531

[52] U.S. Cl. ..... 229/51 TC; 229/45 R
[51] Int. Cl.[2] ..... B65D 5/54; B65D 45/00
[58] Field of Search ..... 229/51 D, 51 TS, 51 TC, 229/51 R, 45

[56] References Cited

UNITED STATES PATENTS

| | | | |
|---|---|---|---|
| 1,606,439 | 11/1926 | Metzger | 229/51 D |
| 2,360,415 | 10/1944 | Gilbert | 229/51 D |
| 2,963,209 | 12/1960 | Hovland | 229/51 D |

*Primary Examiner*—William Price
*Assistant Examiner*—Douglas B. Farrow
*Attorney, Agent, or Firm*—Woodling, Krost, Granger & Rust

[57] ABSTRACT

A tear open and relockable cardboard container is disclosed comprising a first and a second top member having a first and a second top fold and a first and a second top edge which top members are secured in an overlapping relationship to form a top of the container. The first top member has a container aperture perforation with a locking projection extending toward the first edge. Locking slots extend from the sides of the container aperture perforation. The second member has a first and a second perforation with a lift tab fold line extending between the first and second perforation defining a lift tab therebetween. A lift tab perforation is located on the second top member and intersects the lift tab fold line forming a reopen tab. The container is opened by raising the lift tab to expose the container aperture. The container is relocked by inserting the lift tab into the locking slots with the locking projection extending through the lift tab perforation resulting in a first engagement between the lift tab and the bottom surface of the first member and resulting in a second engagement between the reopen tab and the top surface of the first member. The lift tab forms an obtuse angle with the second member resulting in an increase in the force of the first and second engagements by the weight of the contents of the container upon the lift tab when the container is overturned. The foregoing abstract is merely a resume of one general application, is not a complete discussion of all principles of operation or applications, and is not to be construed as a limitation on the scope of the claimed subject matter.

8 Claims, 11 Drawing Figures

TEAR OPEN AND RELOCKABLE CONTAINER

BACKGROUND OF THE INVENTION

1. Field of the Invention

This invention relates to paper receptacles, boxes, openers, ripped, reclosable container cover.

2. Description of the Prior Art

The prior art has attempted to develop an inexpensive cardboard container which may be torn open and reclosed to protect the unused content of the container. The three requirements of a reclosable container are, the container must be inexpensive, the container must be easy to reclose and reopen to the consumer not skilled in the packaging art and the container must provide a sufficient locking strength to prevent spillage of the unused contents of the container when the container is overturned. The prior art has developed many types of reclosable containers incorporating various locking devices but heretofore none of these containers have satisfied the aforementioned three requirements of the packaging art.

One prior art package incorporated a first and a second top member with the second top member having a lift tab which extended through a slot in the first top member wherein the first top member had a locking projection which extended through a slot in the second member. Although the prior package had two separate locking engagements, the engagements were not complementary to one another. Consequently, the container did not use the weight of the unused contents of the container to further secure the locking engagements. This prior art container did not remain closed under the weight of the unused contents of the container when the container was overturned.

A further disadvantage of the prior art containers was that the opening and reclosing instructions had to be printed on the top surface of the container. A more effective way of teaching the consumer the operation of the reclosable container is to print the opening instructions on the top surface of the container while covering the reclosing instructions. Accordingly, when the tear open container is opened, the reclosing instructions are exposed to effectively indicate to the consumer the proper method of reclosing the container.

Therefore, an object of this invention is to provide a tear open and relockable container having a first and a second relocking engagement wherein the force of the first and second engagements is increased by the weight of the contents of the container when the container is overturned.

Another object of this invention is to provide a tear open and relockable container wherein the opening instructions are printed on the top surface of the container and the reclosing instructions are printed to become exposed upon opening the container.

Another object of this invention is to provide a tear open and relockable container with an increased locking strength to keep the unused portion of the contents of the container safe and wholesome for the consumer.

Another object of this invention is to provide a tear open and relockable container which is adaptable to most state of the art containers.

Another object of this invention is to provide a tear open and relockable container which is inexpensive.

SUMMARY OF THE INVENTION

The invention may be incorporated in a tear open and relockable container, comprising in combination side means, bottom means, and top means in the container with said means having a first and a second member including a first and a second edge, respectively, said first member having a container aperture perforation defining a container aperture and with said container aperture perforation including a locking projection extending toward said first edge, said first member having locking slot means, said second member having a first and a second perforation with a lift tap fold line extending between said first and second perforations defining a lift tab therebetween, a lift tab perforation located between said first and second perforations and intersecting said lift tab fold line forming a reopen tab; means for securing said second member to said first member with said second member overlapping said first member for providing a tear open cover along said first and second perforations when said lift tab is raised to expose said defined container aperture; and relocking means including said lift tab being inserted in said locking slot means with said locking projection extending through said lift tab perforation resulting in a first engagement between said lift tab and the bottom surface of said first member and resulting in a second engagement between said reopen tab and the top surface of said first member.

Other objects and a fuller understanding of the invention may be had by referring to the following description and claims, taken in conjunction with the accompanying drawing.

DESCRIPTION OF THE PREFERRED EMBODIMENT

Figure 1:
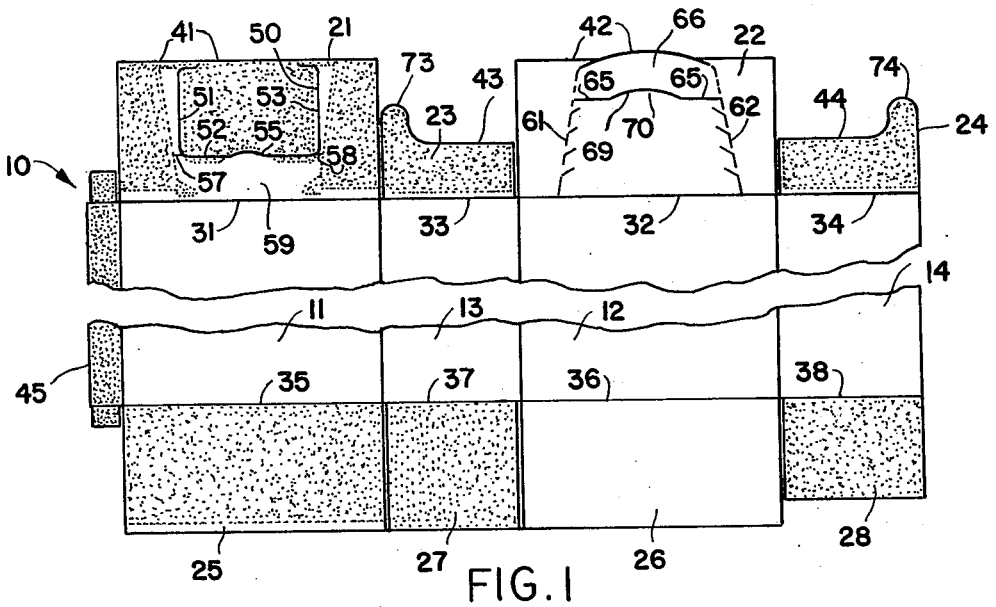
FIG. 1 is a top view of a paperboard container blank.

FIG. 1 is a paperboard blank for forming a tear open and relockable container 10 shown in FIGS. 2–11 wherein first through fourth side members 11–14 are integral with first through fourth top members 21–24 through first through fourth top folds 31–34, respectively. The first through fourth side members 11–14 are also integral with first through fourth bottom member 25–28 through fourth bottom folds 35–38, respectively. The first through fourth top members 21–24 have first through fourth top edges 41–44 which are located on sides opposite to the first through fourth top folds 31–34. A glue tab 45 enables the fourth side member 14 to be affixed adjacent to the first side member 11 when the glue tab 45 is glued to the inside surface of the fourth side member 14 to provide substantially right angle folds between the adjacent side members 11–14. Adhesive is applied to the first, third and fourth bottom members 25, 27 and 28 to provide a bottom for the container as well known to the art.

The invention is shown in this embodiment to be in the first and second top members 21 and 22 wherein the first top member has a container aperture perforation 50 defining three sides 51, 52 and 53 of a generally rectangular aperture with the fourth side thereof being the first edge 41 of the first member 21. The container aperture perforation has a locking projection 55 in the side 52 of the container aperture perforation 50 which is opposite to the first top edge 41 and which locking projection 55 extends toward the first top edge 41. The first top member 21 includes locking slot means 57 and 58 which extend in line with the aperture perforation side 52 and beyond the adjacent sides 51 and 53 to provide a receiving slot for the second member as will hereinafter be described. A U-shaped area comprising areas adjacent to the aperture perforation sides 51 and 53 in addition to an area 59 between the aperture perforation side 52 and the first top fold 31 is coated with a material such as an ink or a lacquer which will not adhere to the container adhesive. Consequently, the aforementioned area will not receive an adhesive thus providing the area 59 for printing reclosing instructions so the consumer may easily reclose the container after it has been opened.

The second top member 22 includes a first and a second perforation 61 and 62 which extend in a converging manner from the second top fold 32 to the second top edge 42. The perforations 61 and 62 are scored and punched through to enable the consumer to easily tear the paper material along the perforation lines 61 and 62. These perforations are well known to the container art. A lift tab fold line 65 extends between the first and second perforations 61 and 62 and is substantially parallel to the second top fold 32 and the second top edge 42. The lift tab fold line 65, the second top edge 42 and the first and second perforations 61 and 62 define a lift tab 66 therebetween. A lift tab perforation 69 is located between the first and second perforations 61 and 62 and intersects the lift tab fold line 65 to form a reopen tab 70 which extends toward the second top edge 42 of the second top member 22.

The third and fourth members 23 and 24 each have a protruding portion 73 and 74 which complement the container aperture perforation 50 at side 52, whereas the remainder of the third and fourth top edges 43 and 44 complement the aperture perforation sides 53 and 51, respectively. This adds strength to the aperture when the carton is fabricated as shown in FIGS. 2–8. The third and fourth members 23 and 24 are adhesively bonded to the underside of the first top member 21 with the second top member adhesively bonded to the top surface of the first top member as shown in FIGS. 2–6.

Figure 2:
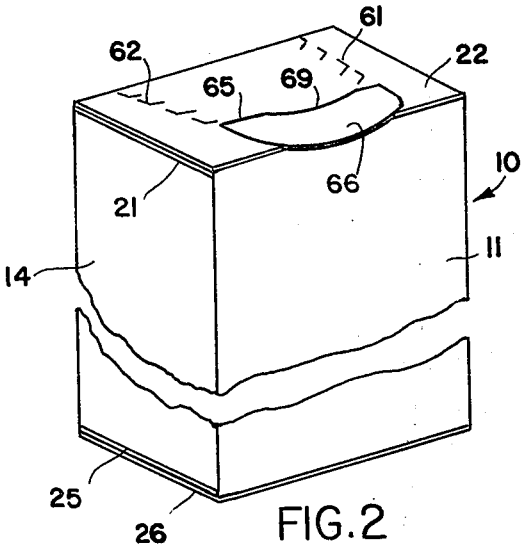
FIG. 2 is a perspective view of the container in the closed position.

The assembled container filled with contents is shown in FIG. 2. The container is distributed to the consumer in this condition.

Figure 3:
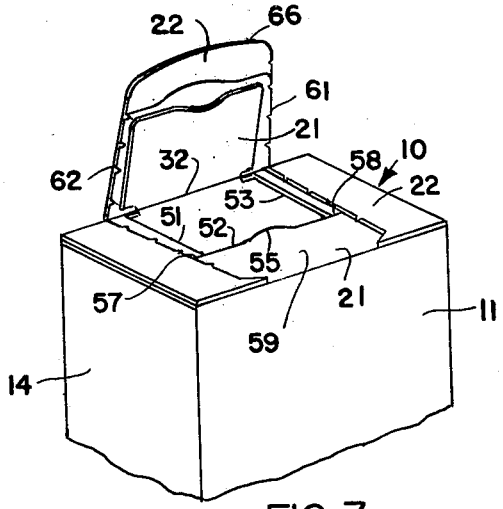
FIG. 3 is a perspective view of a portion of the container in the open position.

FIG. 3 shows the container 10 in the open position wherein the consumer has raised the lift tab 66 to open the container by tearing along the perforations 61 and 62 to the fold line 32. The underside of the second member 22 is adhesively secured to the container aperture defined by the perforation aperture 50 and the container is automatically opened when the lift tab 66 is raised as shown in FIG. 3. Concomitantly, the area of reclose instructions 59 is exposed when the lift tab 66 is raised in the position shown. Since the perforation aperture 50 extends essentially to the first edge 41 as shown in FIG. 1, the perforation aperture extends substantially to the fold 32. Consequently, the contents of the container can be easily removed without content build-up along the second top fold 32 as in the prior art containers.

Figure 4:
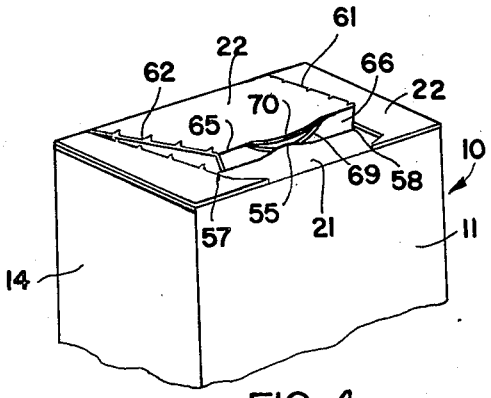
FIG. 4 is a perspective view of a portion of the container in a partially reclosed position.

FIG. 4 illustrates the container 10 in a partially reclosed position. The second member 22 is folded along the lift tab fold line 65 and the lift tab 66 is inserted into the locking slot means 57 and 58 which extend from the side 52 of the container aperture perforation 50. Folding the second member 22 along the lift tab fold line 65 creates a reopen tab 70 extending toward the second top edge 42 to provide a convenient reopen tab for reopening the container.

Figure 5:
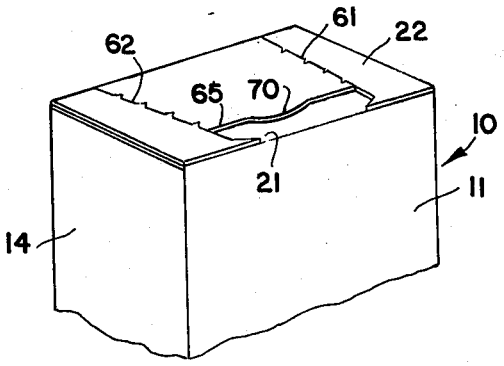
FIG. 5 is a perspective view of a portion of the container in the reclosed position.
Figure 6:
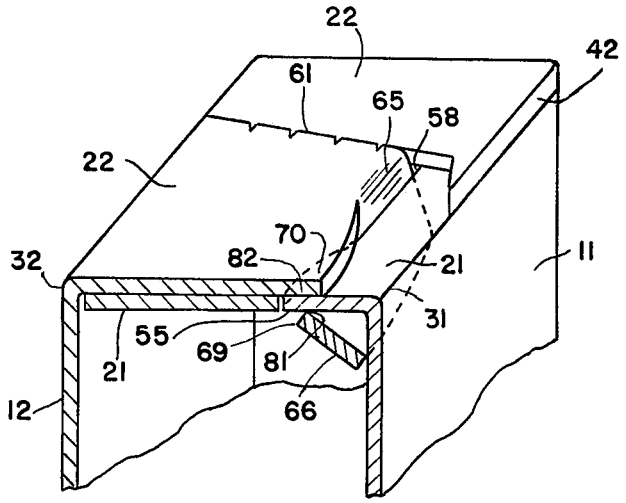
FIG. 6 is a perspective view in section illustrating the first and second engagement of the first top member.
Figure 7:
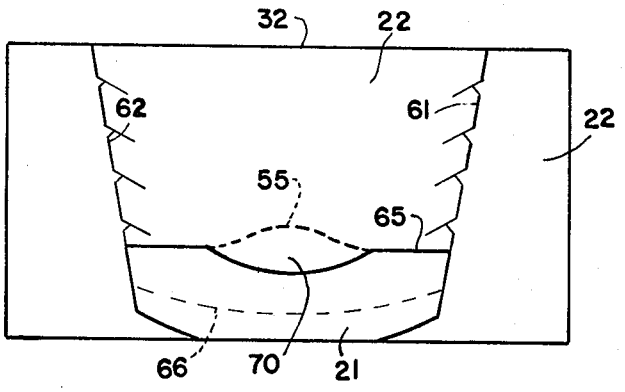
FIG. 7 is a top view of the container shown in FIG. 5.
Figure 8:
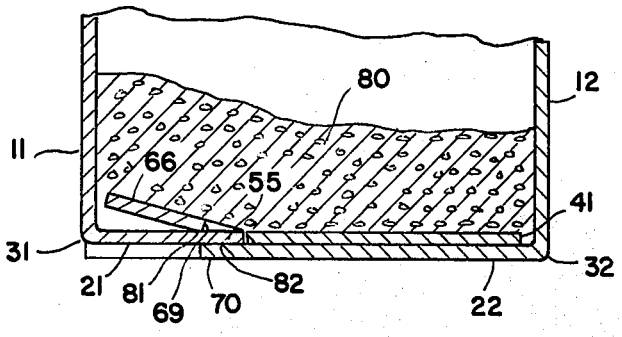
FIG. 8 is a longitudinal sectional view of the container where the container is overturned.

FIG. 5 illustrates the container in the reclosed position wherein the lift tab 66 completely extends into the locking slot means 57 and 58 and the locking projection 55 extends into the lift tab perforation 69 which is more clearly shown in FIGS. 6–8.

FIG. 6 is a perspective sectional view of an enlarged portion of the container 10 shown in FIG. 5 The lift tab 66 is inserted into the locking slot means 58 forming an obtuse angle between the lift tab 66 and the second top member 22 with the locking projection 55 extending through the lift tab perforation 69 causing a first engagement 81 between the lift tab 66 and the bottom surface of the first member 21 and resulting in a second engagement 82 between the reopen tab 70 and the top surface of the first member 21 at the locking projection 55. The fact that the lift tab 66 extends forwardly forming and obtuse angle with the second top member 22 provides the necessary cooperation between the container structure and the contents of the container which causes an increase in the force of the first and second engagements 81 and 82 when the container is overturned.

FIG. 7 is a top view of the container in the reclosed position showing in greater detail the relative positions of the reopen tab 70, the locking projection 55 at the lift tab 66 relative to the first and second top members 21 and 22.

FIG. 8 is a longitudinal sectional view of the container shown in FIGS. 5–7 in an overturned position showing the contents 80 of the container exerting a force upon the lift tab 66 to increase the force of the first engagement 81 between the lift tab 66 and the bottom surface of the first member 21 and to increase the force of the second engagement 82 between the reopen tab 70 and the top surface of the first top member 21 at the locking projection 55. The weight of the contents 80 of the container effectively squeezes the first top member 21 between the lift tab 66 and the reopen tab 70 to take advantage of the weight of the contents 80 of the container to further secure the container. The prior art containers often would disengage and open when a substantially full reclosed container was overturned, whereas the present invention has solved these long persisting problems of the prior art and has provided a novel container structure which uses the adverse weight of the contents of the container to increase the engagement force of the locking cover resulting in a stronger locking container. The present container can be overturned when the container is completely full and vigorously shaken without the container opening, thereby avoiding loss of the contents of the container.

Figure 9:
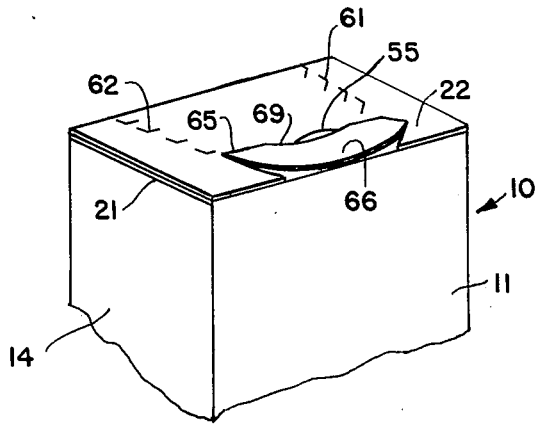
FIG. 9 is a perspective view of the container in an alternate reclosed position.
Figure 10:
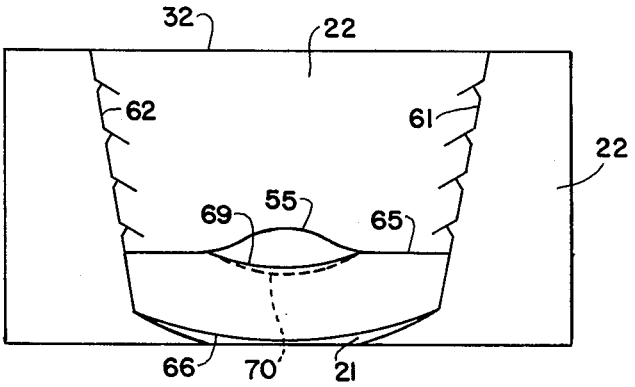
FIG. 10 is a a top view of the container shown in FIG. 9.
Figure 11:
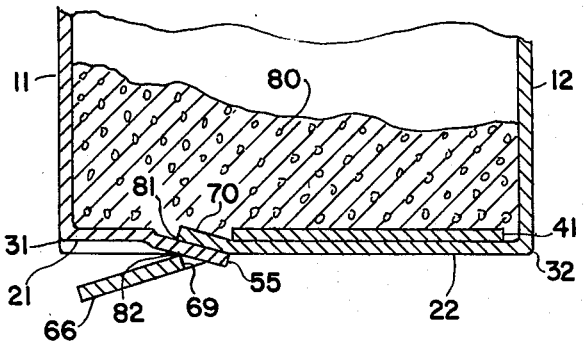
FIG. 11 is a longitudinal sectional view of the container when the container is overturned.

The paperboard blank shown in FIG. 1 can be alternately reclosed as shown in FIGS. 9–11. The locking slot means 57 and 58 shown in FIGS. 1, 3 and 4 are not required since the lift tab 66 extends outside of the container 10 forming an obtuse angle with the second top member 22. The reopen tab 70 is locked by the locking projection 55 with the lift tab 66 engaging the top surface of the first top member 21. The container 10 is reclosed by pressing down on the second top member 22 in an area between the first and second perforations 61 and 62, the lift tab perforation 69 and the second top fold 32 to deform the first and second side members 11 and 12 to allow the reopen tab 70 to extend below the locking projection 55. The first and second side members 11 and 12 return to the normal position with the locking projection 55 being engaged between the reopen tab 70 and lift tab 66.

FIG. 10 shows a top view of the container in FIG. 9 illustrating the relative position of the locking projection 55, the lift tab 66 and the reopen tab 70.

FIG. 11 is a longitudinal sectional view of the container in FIGS. 9 and 10 in the overturned position. The contents 80 exert a force upon the reopen tab 70 providing a first engagement 81 between the reopen tab 70 and the bottom surface of the first top member 21 and providing a second engagement 82 between the top surface of the first top member 21 and the lift tab 66. The force of the first and second engagements 81 and 82 is increased by the weight of the contents 80 of the container upon the reopen tab 70 to enable the container to be overturned without reopening. The paperboard blank of FIG. 1 may be reclosed in the perferred manner illustrated in FIG. 2–8 and in the alternate manner illustrated in FIG. 9–11 and both are included within the scope of the present invention.

The invention has been described as a tear open and relockable container comprising a container having side means 11–14, bottom means 25–28, and top means 21–24, with said means having a first and second member shown as 21 and 22 including a first and second edge 41 and 42, respectively. The first member 21 has a container aperture 50 defining a locking projection 55 extending toward the first edge 41. The second member has a first and second perforation 61 and 62 with a lift tab fold line 65 extending between these first and second perforations 61 and 62 thereby defining a lift tab 66. A lift tab perforation 69 is located between the first and second perforations 61 and 62 and intersecting the lift tab fold line 65 forming a reopen tab 70. Adhesive means secure the second member 22 to the first member 21 with the second member 22 overlapping the first member 21 for providing a tear open cover along the first and second perforations 61 and 62 when the lift tab 66 is raised to expose the defined container aperture 50. Relocking is accomplished by the lift tab 66 forming an obtuse angle with the second member 22 and the locking projection 55 extending through the lift tab perforation 69 resulting in a first engagement 81 between one of the tabs 66 and 70 and the bottom surface of the first member 21 and resulting in a second engagement between the other of the tabs 66 and 70 and the top surface of the first member 21.

The present invention disclosure includes that contained in the appended claims, as well as that of the foregoing description. Although this invention has been described in it preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A tear open and relockable container, comprising in combination:

side means, bottom means, and top means in the container with said means having a first and a second member including a first and second edge, respectively, said first member having a container aperture perforation defining a container aperture and with said container aperture perforation including a locking projection extending toward said first edge, said first member having locking slot means extending in line with a side of said container aperture, said second member having a first and a second perforation with a lift tab fold line extending between said first and second perforations defining a lift tab therebetween, a lift tab perforation located between said first and second perforations and intersecting said lift tab fold line forming a reopen tab;

adhesive means for securing said second member to said first member with said second member overlapping said first member with said lift tab being in an initial position relative to the remainder of said second member for providing a tear open cover along said first and second perforations when said lift tab is raised thereby removing the portion of said first member defined by the container aperture in accordance with the movement of said second member to open the container;

and relocking means including said lift tab being inserted in said locking slot means with said locking projection extending through said lift tab perforation resulting in a first engagement between said lift tab and the bottom surface of said first member and resulting in a second engagement between said reopen tab and the top surface of said first member whereby said lift tab is biased to return to said initial position relative to the remainder of said second member by action of the content of the container on said lift tab when the container is overturned to increase the force of said first and second engagements.

2. A container as set forth in claim 1 wherein said container aperture perforation defines a container aperture which extends substantially to an edge of the container.

3. A container as set forth in claim 1 including means for eliminating adhesion between said first member and said lift tab to provide an area for reclosing instructions.

4. A tear open and relockable container, comprising in combination:

the container having side means, bottom means, and top means with said means having a first and a second member including a first and a second edge and a first and a second fold, respectively.

said first member having perforation means including a container aperture perforation defining a container aperture with a side thereof extending substantially to said first edge of said first member;

said aperture perforation having a locking projection in a side of said perforation being opposite said first edge with said locking projection extending toward said first edge;

said perforation means including locking slot means extending in line with said side opposite said first edge and beyond the adjacent side of said aperture perforation;

said second member having a first and a second perforation extending from said second fold to said second edge;

a lift tab fold line extending between said first and second perforations of said second member and being substantially parallel to said second fold;

said first and second perforations and said lift tab fold line and second edge defining a lift tab therebetween;

a lift tab perforation located between said first and second perforations and intersecting said lift tab fold line forming a reopen tab extending toward said second edge;

adhesive means securing said second member to the top of said first member for providing a tear open cover along said first and second perforations when said lift tab is raised;

said adhesive means securing the portion of said first member defined by said container aperture to the portion of said second member comprising said tear open cover to remove said portion of said first member defined by said container aperture in accordance with the movement of said tear open container thereby;

and relocking means including said lift tab being inserted in said locking slot means and forming an obtuse angle with said second member with said locking projection extending through said lift tab perforation resulting in a first engagement between said lift tab and the bottom surface of said first member and resulting in a second engagement between said reopen tab and the top surface of said first member whereby the contents of the container causes an increase in the force of said first and second engagements when the relocked container is overturned.

5. A tear open and relockable container, comprising in combination:

first through fourth sides being integral with first through fourth top members through first through fourth top folds being integral with first through fourth bottom members through first through fourth bottom folds, respectively;

said first through fourth top members having first through fourth top edges on sides opposite said first through fourth top folds, respectively;

means for securing said sides to one another forming right angle folds between adjacent sides;

adhesive means securing said first through fourth bottom members for forming right angles at said first through fourth bottom folds to provide a bottom of the container;

said first top member having perforation means including a container aperture perforation defining three sides of a generally rectangular container aperture with the fourth side thereof being said first top edge;

said aperture perforation having a locking projection in a side of said aperture perforation being opposite said first top edge with said locking projection extending toward said first top edge;

said perforation means including locking slot means extending in line with said side opposite said first top edge and beyond the adjacent side of said aperture perforation;

said second top member having a first and a second perforation extending from said second top fold to said top edge;

a lift tab fold line extending between said first and second perforations of said second top member and being substantially parallel to said second top fold;

said first and second perforations and said lift tab fold line and said second top edge defining a lift tab therebetween;

a lift tab perforation located between said first and second perforations and intersecting said lift tab fold line forming a reopen tab extending toward said second top edge;

said third and fourth top members having protruding portions on said third and fourth edges with said protruding portions complementing said side of said aperture perforation having said locking projection and with the remainder of said third and fourth edges complementing said other sides of said aperture perforation;

means for securing the third and fourth members to the bottom of said first top member;

coating means for established on said top member between said first fold and said container aperture for preventing adhesive from bonding to said first top member covered by said coating;

said coating including printed instructions for reclosing the container;

adhesive means for securing said second top member to the top of said first top member for providing a tear open cover along said first and second perforation when said lift tab is raised;

said adhesive means securing the portion of said first top member defined by said container aperture to the portion of said second top member comprising said tear open cover to remove said portion of said first top member defined by said container aperture in accordance with the movement of said tear open cover and to open the container and to expose said instructions of said coating means;

and relocking means including said lift tab being inserted in said locking slot means and forming an obtuse angle with said second member with said locking projection extending through said lift tab perforation resulting in a first engagement between said lift tab and the bottom surface of said first member and resulting in a second engagement between said reopen tab and the top surface of said first member whereby the contents of the container causes an increase in the force of said first and second engagements when the relocked container is overturned.

6. A tear open and relockable container, comprising in combination:

side means, bottom means, and top means in the container with said means having a first and a second member including a first and a second edge, respectively, said first member having a container aperture perforation defining a container aperture and with said container aperture perforation including a locking projection extending toward said first edge;

said second member having a first and a second perforation with a lift tab fold line extending between said first and second perforations defining a lift tab therebetween, a lift tab perforation located between said first and second perforations and intersecting said lift tab fold line forming a reopen tab;

adhesive means for securing said second member to said first member with said second member overlapping said first member with said lift tab being in an initial position relative to the remainder of said second member for providing a tear open cover along said first and second perforations when said lift tab is raised thereby removing the portion of said first member defined by the container aperture in accordance with the movement of said second member to open the container;

and relocking means including said lift tab forming an obtuse angle with said remainder of said second member and said locking projection extending through said lift tab perforation resulting in a first engagement between one of said tabs and the bottom surface of said first member and resulting in a second engagement between the other of said tabs and the top surface of said first member whereby said lift tab is biased to return to said initial position relative to the remainder of said second member by action of the content of the container when the container is overturned to increase the force of said first and second engagements.

7. A container as set forth in claim 6 wherein said relocking means includes the weight of the contents of the overturned container being applied against said lift tab.

8. A container as set forth in claim 6 wherein said relocking means includes the weight of the contents of the overturned container being applied against said reopen tab.

* * * * *